US007048272B2

(12) United States Patent
Lay et al.

(10) Patent No.: US 7,048,272 B2
(45) Date of Patent: May 23, 2006

(54) MEDIA QUALIFICATION ACCESSORY AND METHOD

(75) Inventors: D. Travis Lay, Horseshoe Bend, ID (US); Curtis Reese, Boise, ID (US); Pat Dowdell, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 233 days.

(21) Appl. No.: 10/302,432

(22) Filed: Nov. 21, 2002

(65) Prior Publication Data

US 2004/0100016 A1 May 27, 2004

(51) Int. Cl.
*B65H 5/00* (2006.01)

(52) U.S. Cl. ..... 271/225; 271/298; 399/45; 73/159

(58) Field of Classification Search ..... 209/1, 209/2, 509, 534, 552, 555; 271/225, 298; 399/45, 361, 411, 390, 406; 73/159, 73
See application file for complete search history.

(56) References Cited

U.S. PATENT DOCUMENTS

| | | | | |
|---|---|---|---|---|
| 3,938,663 | A * | 2/1976 | Carnes et al. | 209/534 |
| 4,025,420 | A * | 5/1977 | Horino | 209/534 |
| 4,345,150 | A | 8/1982 | Tamura et al. | |
| 4,577,104 | A | 3/1986 | Sturm | |
| 4,747,911 | A | 5/1988 | Polson | |
| 4,755,678 | A | 7/1988 | Izatt et al. | |
| 4,771,631 | A | 9/1988 | Lehtikoski et al. | |
| 5,049,924 | A * | 9/1991 | Moro et al. | 355/50 |
| 5,182,722 | A * | 1/1993 | Hain | 700/223 |
| 5,394,247 | A | 2/1995 | Vahey et al. | |
| 5,831,741 | A | 11/1998 | Milillo | |
| 5,934,140 | A * | 8/1999 | Jackson et al. | 73/159 |
| 5,986,457 | A * | 11/1999 | Kayani | 324/671 |
| 6,028,318 | A | 2/2000 | Cornelius | |
| 6,040,584 | A * | 3/2000 | Liu et al. | 250/559.11 |
| 6,355,931 | B1 | 3/2002 | Hernandez et al. | |
| 6,394,676 | B1 | 5/2002 | Dresher | |
| 6,396,070 | B1 | 5/2002 | Christensen et al. | |
| 6,654,573 | B1 * | 11/2003 | Carlson et al. | 399/92 |
| 6,718,145 | B1 * | 4/2004 | Ohta et al. | 399/16 |

FOREIGN PATENT DOCUMENTS

GB 2.093.809 A * 9/1982

OTHER PUBLICATIONS

Sidles, Constance J., "Buying Laser Paper That Won't Jam," Mar./Apr. 1996, Adobe Magazine, pp. 21-22.

* cited by examiner

*Primary Examiner*—Donald P. Walsh
*Assistant Examiner*—Mark J. Beauchaine

(57) ABSTRACT

A media qualification device configured to sort media sheets according to one or more detected media characteristics. The media qualification device comprises a media sensor, an unusable media path and at least one usable media path. Qualified media sheets may be passed to a sheet-fed device for image processing. Qualified media sheets may be sorted among a plurality of usable media paths according to media grade. The media qualification device may further comprise an input/output device configured to select media grade parameters.

14 Claims, 3 Drawing Sheets

MEDIA QUALIFICATION ACCESSORY AND METHOD

BACKGROUND OF THE INVENTION

1. Field of the Invention

The present invention relates to a method and apparatus for determining the acceptability of media for use in electronic devices. More particularly, the present invention relates to methods and devices for screening sheets of media products for use in electronic devices such as multifunction devices, printers, facsimile machines, copiers, scanners, and the like.

2. State of the Art

Sheet-fed devices, such as printers, copiers, facsimile machines, multifunction devices, and the like, occasionally experience errors or malfunctions that interrupt productivity or effect quality. One of the most common problems occurring with sheet-fed devices is known as a "paper jam" wherein a sheet of media becomes trapped in the feeder of the sheet-fed device and prevents further sheets from being fed until the "jammed" sheet is cleared. Paper jams are usually the product of equipment malfunctions or result from the type and quality of media being used with the sheet-fed device.

The characteristics of the media fed to the sheet-fed device may cause paper jams. Media with too much moisture content may be too limp and may crumple when pushed by the rollers of the feeder. Media with too little moisture content may build up an electrostatic charge on its surface causing it to cling to other surfaces. Furthermore, media with too little moisture content or that is too stiff may crumple rather than travel around the bends of a sheet-fed device. Media that has a tendency to curl when heated during the fusing portion of a printing process may miss a feeder roller when curled. Media that has a smooth surface texture may not have enough friction for the feeder rollers to push it at high speeds. These and other media characteristics may contribute to paper jams and other problems resulting in significant downtime in printing and copying processes. The media characteristics may also damage the sheet-fed device. For example, an abrasive coating on a sheet of media may damage the feeder rollers or other surfaces that come in contact with the sheet.

The characteristics of the media fed to the sheet-fed device may reduce the quality of imaging processes performed by the sheet-fed device, namely, printing, faxing, copying, scanning, or other printed material analysis. For example, media with a high moisture content may have a reduced toner adhesion while media with a low moisture content may have uneven electrical properties across the surface causing toner to get pulled away from its intended location.

In order to avoid paper jams, damage and reduced quality caused by the use of inappropriate media with certain sheet-fed devices, the sheet-fed devices usually include instructions and specifications for reducing or preventing paper jams. In addition to the instructions for proper use of the sheet-fed device, supported media specifications defining the appropriate specifications for sheet-fed media are also recommended. The supported media specifications typically define the types of media that may be safely utilized with the sheet-fed device. For instance, supported media specifications typically include recommendations regarding the weight of the media, the surface quality of the media, the types of media compatible with the sheet-fed device, and other recommendations based upon media qualities. In many instances, instructions accompanying the sheet-fed device will also recommend that media specially made for the particular sheet-fed device be used with the device. Different types of media are manufactured with different specifications for better compatibility with laser printers, inkjet printers, copiers, and the like. Thus, a particular media with specifications falling within the supported media specifications may be purchased based upon the intended purpose under which the media is marketed and sold.

Specialty media is not always used, however, and oftentimes, the supported media specifications are not followed. Instead, the cheapest media or the only available media is used with a sheet-fed device. The use of media having qualities falling outside of the supported media specification recommendations can cause damage to the sheet-fed device and increase the chance of paper jams. These problems are especially prevalent in those instances where recycled media or multi-use media is used with a sheet-fed device. For instance, used media is often used a second time before being discarded or recycled. In some instances, a sheet printed on only one side is reused and printing is also performed on the other side. The custom of reusing media may be useful for draft copying or printing where the appearance of the final document is not important. However, media products typically undergo changes during a printing or copying process that can affect the quality of the media and render the media unusable.

The use of media that fails to meet the supported media specifications with sheet-fed devices leads to paper jams, machine damage and reduced quality, all of which reduce productivity and increase the costs of printing with sheet-fed devices. Therefore, a method and an apparatus for determining whether or not media to be used with a sheet-fed device is suitable for the particular device are desirable.

BRIEF SUMMARY OF THE INVENTION

A media qualification device and method are disclosed herein. The media qualification device comprises an input tray configured to hold a plurality of media sheets and a media sensor configured to detect at least one media characteristic of a media sheet transported to the media sensor. The media qualification device is configured to sort the media sheets according to selectable media parameters. The media qualification device may further comprise an input/output device configured to allow a user of the media qualification device to select the media parameters according to desired image processing or compatibility with a particular sheet-fed device.

The media qualification device is configured to sort media sheets that fail to satisfy the media parameters to an unusable media path. The unusable media path may terminate in a high capacity output tray. In one embodiment of the present invention, the media sheets that qualify according to the selected media parameters are sorted to a usable media path. The usable media path may terminate in a high capacity output tray. Alternately, the usable media path may feed directly into a sheet-fed device. In another embodiment of the present invention, the media sheets are sorted into a plurality of media grades, each grade defined by selected media parameters. Each media grade may have a corresponding usable media path terminating in a high capacity output tray.

In another embodiment of the present invention, a sheet-fed device is configured to sort media sheets according to media parameters before further processing the sheets. The sheet-fed device may comprise a sensor configured to detect at least one media characteristic. The sheet-fed device may further comprise an input/output device configured to allow a user to select the media parameters. Media sheets that fail to satisfy the media parameters are sorted to an unusable media path. The sheet-fed device may further comprise imaging circuitry, and media sheets that qualify according to the selected media parameters may be sorted to the imaging circuitry for image processing.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
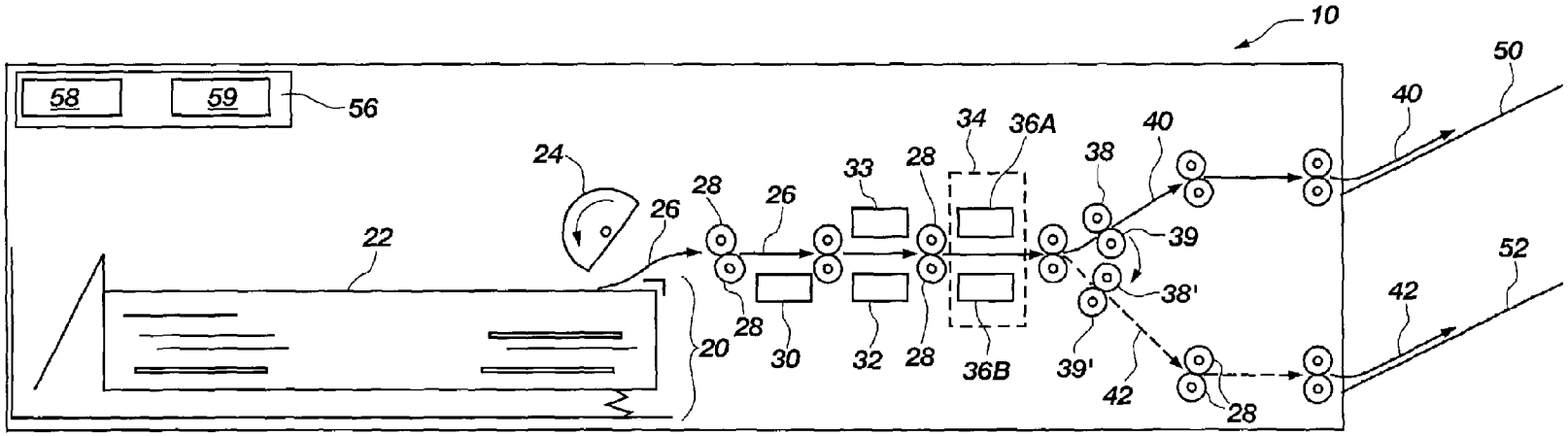
FIG. 1 is a partial sectional side view of a media qualification device in accordance with the present invention.

FIG. 1 is a partial sectional side view of a media qualification device 10 according to the present invention. Media qualification device 10 comprises an input tray 20, an input path 26, sensors 30, 32, 33, 34, a usable media path 40 and an unusable media path 42. The input tray 20 may be configured to hold media 22 to be qualified for use with a sheet-fed device (not shown). Advantageously, the input tray 20 may be a high capacity paper tray configured to receive a large number of stacked media sheets 22. Alternatively, the input tray 20 may be configured to receive one media sheet at a time for processing with the media qualification device 10. The media sheets 22 may be paper, transparencies or other media stock of the general dimensions conventionally used with sheet-fed devices such as laser printers, inkjet printers, dye-transfer printers, facsimile machines, copiers, scanners, and the like.

The media qualification device 10 may also include path control elements configured to transport and guide the media sheets 22, one at a time, along the input path 26 past the sensors 30, 32, 33, 34, and along the usable media path 40 or the unusable media path 42. As shown in FIG. 1, path control elements may include a feed roller 24 configured to pick up the top sheet from the stacked media sheets 22 and advance it to a pair of transport rollers 28 (multiple pairs shown). Multiple pairs of transport rollers 28 may be configured to transport sheets along the input path 26, the usable media path 40 and the unusable media path 42. The media qualification device 10 may also include sheet guides (not shown) configured to guide sheets along the paths 26, 40, 42 while the sheets are being pushed by pairs of transport rollers 28. The media qualification device 10 may also include sheet guides (not shown) coupled to a pair of path selection rollers 38, 39 configured to selectively move between the usable media path 40 and the unusable media path 42. FIG. 1 shows the path selection rollers 38, 39 positioned so as to pass sheets to the usable media path 40. The path selection rollers 38, 39 are also represented with dashed lines as rollers 38' and 39', positioned to pass sheets to the unusable media path 42.

Figure 2:
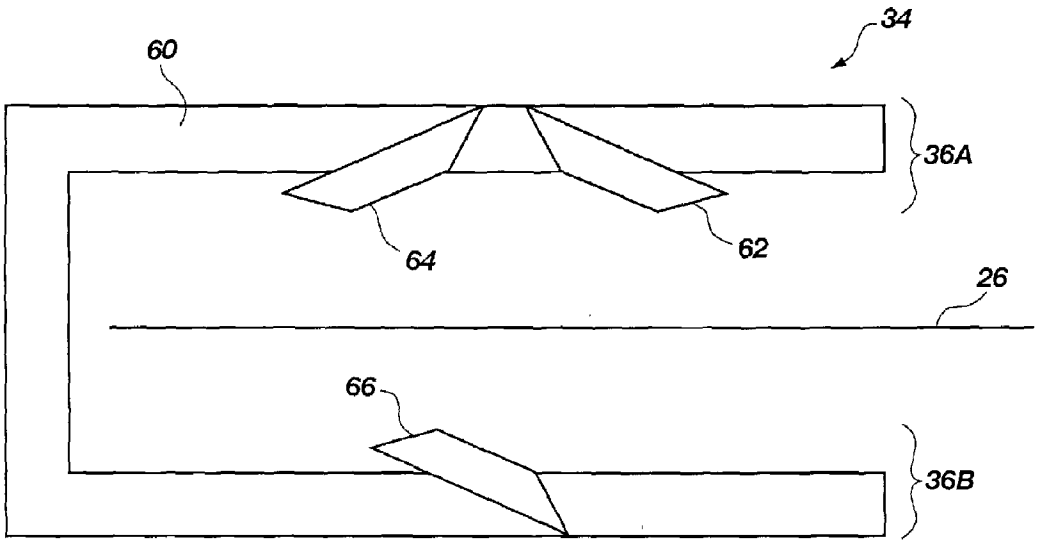
FIG. 2 is a cross-sectional view of a sensor located in a sheet guide according to one embodiment of the present invention.

While FIG. 1 shows the input path 26 passing by a total of four sensors 30, 32, 33, 34, any number of sensors may be used (including a single sensor). The sensors 30, 32, 33, 34 may be positioned proximate the input path 26 so as to be exposed to or make contact with sheets passing along the input path 26. As shown in FIG. 1, sensors 30 and 32 are positioned below a planar surface of the input path 26 and sensor 33 is positioned above the planar surface of the input path 26. By way of example only, placing sensors on either side of the planar surface may be advantageous to detect curl, tendency to curl, creases or folds, output data (e.g., information already printed on one or both sides of a media sheet) and other media characteristics. Sensor 34 is positioned above and below the planar surface of the input path 26 to allow the input path 26 to pass between sensor elements 36A and 36B. Referring to FIG. 2, an exemplary embodiment of sensor 34 is shown positioned in a sheet guide 60. The sheet guide 60 has a u-shaped cross-sectional configuration that allows the input path 26 to pass between sensor elements 36A and 36B. As shown in FIG. 2, sensor element 36A may comprise a transmitting element 62 configured to transmit electromagnetic energy towards a sheet passing along the input path 26 and a receiving element 64 configured to detect a portion of the electromagnetic energy reflected off the sheet passing along the input path 26. Sensor element 36B may comprise a receiving element 66 configured to detect a portion of the electromagnetic energy transmitted through the sheet passing along the input path 26.

Referring again to FIG. 1, the sensors 30, 32, 33, 34 are media sensors configured to collect data relative to the characteristics of the media 22. By way of example only, and not by limitation, the media sensors 30, 32, 33, 34 may be configured to collect data relative to the determination of media density, moisture content, curl, tendency to curl, crease, size, weight, stiffness, surface texture, electrical uniformity, output data, usable side and previous fusion. A sensor 30, 32, 33, 34 may be configured to determine a single media characteristic or a plurality of media characteristics. For example, sensor 30 may be a density sensor and analysis performed on the data collected from the sensor 30 may be used to determine the density, moisture content, weight, stiffness and other characteristics of a media sheet passing along the input path 26.

The media qualification device 10 may also include output trays 50, 52 configured to receive the media sheets 22 as they are passed to the outputs of the media paths 40, 42. Output tray 50 may be configured to detachably attach to the media qualification device 10 at the output of the usable media path 40. Output tray 52 may be configured to detachably attach to the media qualification device 10 at the output of the unusable media path 42. Alternatively, the media qualification device 10 may be configured to detachably attach to a sheet-fed device (not shown) such that sheets passing to the output of the usable media path 40 are fed directly to the sheet-fed device or are passed to an input tray of the sheet-fed device.

The media qualification device 10 may also include an input/output device depicted in FIG. 1 as a control panel 56 comprising a control pad or keypad 58 and a display 59. The control panel 56 may be configured to allow a user of the media qualification device 10 to select the grade parameters of the media sheets 22 to be tested. Grade parameters may comprise the media characteristics to test for and the upper and lower limits of one or more of the media characteristics. For example, a grade parameter may include the upper and lower moisture content percentages allowed for a sheet of media to qualify as a specified media grade or for use with a particular sheet-fed device. In one embodiment of the present invention, usable media path 40 may comprise a plurality of grade paths (not shown) and the path selection rollers 38, 39 may be configured to pass sheets to a qualifying grade path of the plurality of grade paths or to the unusable grade path 42 according to the selected grade of a selected media characteristic or combination of media characteristics.

Figure 3:
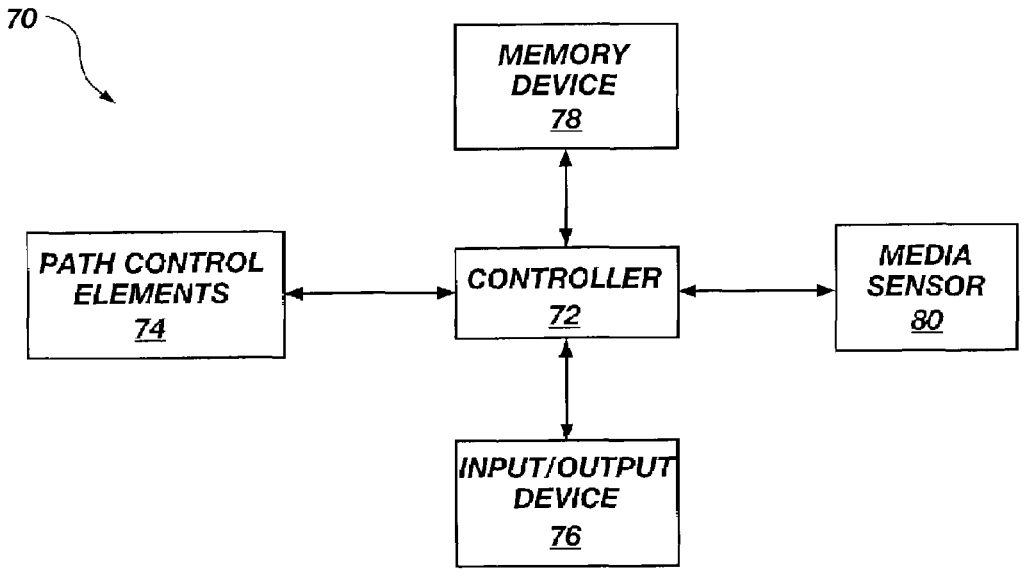
FIG. 3 is a block diagram of electrical circuitry of one embodiment of the present invention.

Referring to FIG. 3, a block diagram of electrical circuitry 70 of one embodiment of the present invention is shown. The electrical circuitry 70 comprises a controller 72 electrically coupled to path control elements 74, an input/output device 76, a memory device 78 and a media sensor 80. Path control elements 74 may, by way of example only, be selected from the group comprising input and output paper trays, sheet guides, path selection sheet guides, path selection rollers, feed rollers, and transportation rollers. The input/output device 76 may, by way of example only, be selected from the group comprising a switch, a control panel, a processor, a microcontroller, a computer, a memory device and a sheet-fed device. The input/output device 76 may be configured to set grade parameters including upper and lower limits for one or more media characteristics to be tested. The input/output device 76 may be configured to select one or more preset grade parameters from the memory device 78. The selection of the grade parameters may be automatic. For example, a sheet-fed device acting as the input/output device 76 may automatically communicate to the controller 72 the grade parameters to qualify media sheets for use with the sheet-fed device. Alternately, the selection of the grade parameters may be manual. For example, a user may be required to set a switch acting as the input/output device 76 to select preset grade parameters.

The media sensor 80 is configured to detect at least one media characteristic. By way of example only, and not by limitation, the media sensor 80 may be configured to detect characteristics such as media density, moisture content, curl, tendency to curl, crease, size, weight, stiffness, surface texture, electrical uniformity, output data, usable side and previous fusion. The controller 72 is configured to sort media sheets by grade according to the media characteristics detected by the media sensor 80 as compared to the selected grade parameters. The controller 72 may be configured to sort a media sheet to an unusable media output path if the detected media characteristics are not within the upper and/or lower limits of the selected grade parameters. Otherwise, the controller 72 may be configured to sort the media sheet to a usable media path. The controller 72 may also be configured to sort the media sheet to one of a plurality of usable media paths, or grade paths, if the detected media characteristics are within the upper and/or lower limits of a corresponding grade parameter of a plurality of selected grade parameters.

Figure 4:
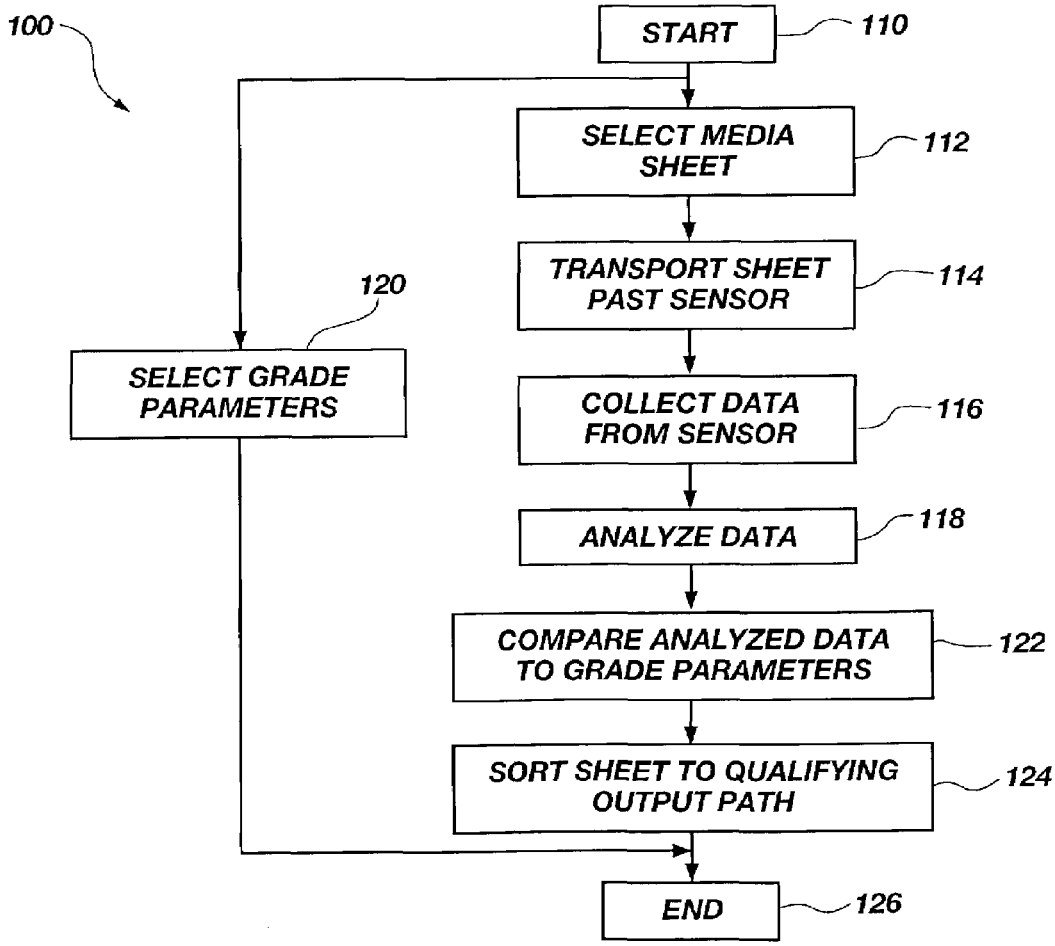
FIG. 4 is a flow diagram illustrating a method for sorting media sheets according to one embodiment of the present invention.

Referring to FIGS. 3 and 4, FIG. 4 is a flow diagram of a process 100 illustrating how the controller 72 of FIG. 3 is configured to qualify media sheets according to one embodiment of the present invention. After starting 110 the process 100, the controller 72 is configured to control the path control elements 74 to select 112 a media sheet and transport 114 the sheet past the sensor 80. A sheet may be selected from a plurality of stacked media sheets in an input tray using a feed roller, similar to the stacked media sheets 22, input tray 20 and feed roller 24 shown in FIG. 1. Upon starting 110, the controller may also be configured to prompt the input/output device 76 to select 120 grade parameters to be received by the controller 72.

Once a sheet reaches the sensor 80, the controller is configured to collect 116 data from the sensor and to analyze 118 the data to determine one or more media characteristics of the sheet. Then, the analyzed data is compared 122 to the received grade parameters to determine whether the media characteristic or combination of media characteristics qualifies the sheet for a media grade corresponding to the grade parameters selected. Qualifying for a media grade may, for example, qualify the sheet for a particular quality level for image processing or for use with a particular sheet-fed device. Comparing 122 the analyzed data to the grade parameters may include querying whether the media characteristics are within the upper and/or lower limits of the received grade parameters. The controller 72 is configured to sort 124 the sheet to an output path corresponding to the qualifying grade of the sheet. The controller 72 sorts 124 the sheet by controlling path control elements 74 such as path selection sheet guides and/or rollers. Once the sheet is sorted 124, the process ends 126.

Figure 5:
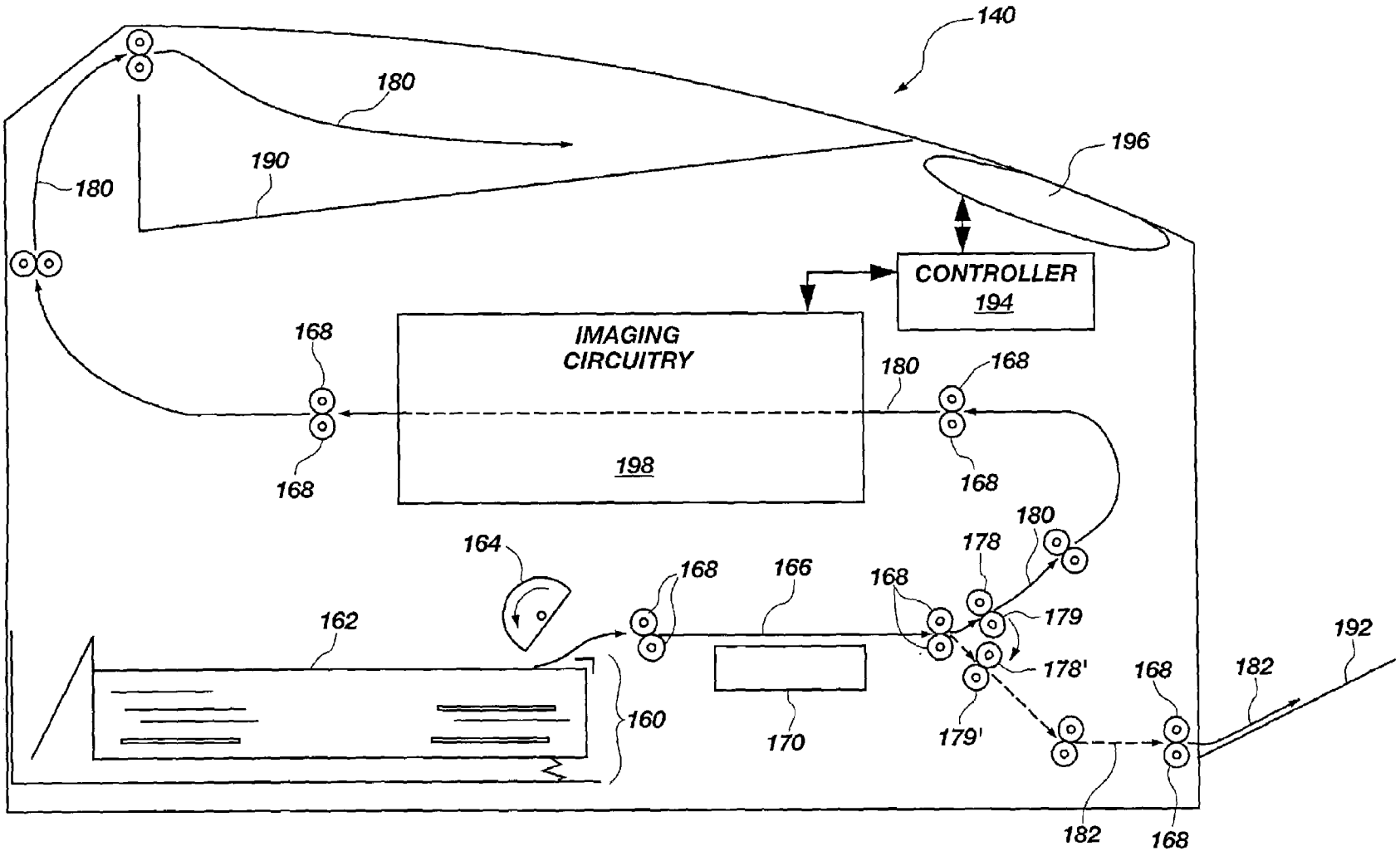
FIG. 5 is a partial sectional side view of a sheet-fed imaging device in accordance with one embodiment of the present invention.

FIG. 5 is a partial sectional side view of a sheet-fed imaging device 140 such as a multifunction device, laser printer, inkjet printer, dye-transfer printer, facsimile machine, copier, scanner, and the like according to one embodiment of the present invention. The imaging device 140 comprises an input tray 160, an input path 166, a sensor 170, an imaging path 180, an unusable media path 182, a controller 194 and imaging circuitry 198. The input tray 160 may be a high capacity paper tray configured to hold a large number of stacked media sheets 162. The imaging device may also comprise path control elements including a feed roller 164 configured to pick up the top sheet from the stacked media sheets 162 and advance it to a pair of transport rollers 168 (multiple pairs shown). Multiple pairs of transport rollers 168 may be configured to transport the sheet along the input path 166, imaging path 180 and unusable media path 182. The path control elements may also include sheet guides (not shown), path selection sheet guides (not shown) and path selection rollers 178, 179 configured to selectively move between the imaging path 180 and the unusable media path 182. FIG. 5 shows the path selection rollers 178, 179 positioned so as to pass sheets to the imaging path 180. The path selection rollers 178, 179 are also represented with dashed lines as rollers 178' and 179', positioned to pass sheets to the unusable media path 182.

The sensor 170 is configured to collect data relative to the characteristics of the media sheets 162. By way of example only, and not by limitation, the sensor 170 is configured to collect data relative to the determination of media density, moisture content, curl, tendency to curl, crease, size, weight, stiffness, surface texture, electrical uniformity, output data, usable side and previous fusion. The imaging circuitry 198 is electrically coupled to the controller 194 and comprises circuitry necessary for image processing, namely, scanning, copying, printing, faxing, or other printed material analysis. The imaging device 140 may further comprise a control panel 196 electrically coupled to the controller 194. The control panel 196 may be configured to allow a user of the imaging device 140 to control imaging processes and to select media grade parameters.

The controller 194 is configured to receive data from the sensor 170 relative to a media characteristic or combination of media characteristics and to analyze the data to determine whether the media passing by or through the sensor 170 qualifies for use with the imaging device 140. The controller 194 may comprise a nonvolatile memory device (not shown) configured to store grade or sorting parameters which the controller 194 may compare to the data to qualify the media for use with the imaging device 140. Alternatively, the controller 194 may be configured to receive grade parameters from the control panel 196. The controller 194 is configured to sort sheets that do not qualify for use with the imaging device 140 to the unusable media path 182 where the media sheets will be sent to the unusable media output tray 192. The controller 194 is also configured to sort sheets that do qualify for use with the imaging device 140 to the imaging path 180 where the media sheets will be transported to the imaging circuitry 198 for image processing. After image processing, the transport rollers 168 are configured to pass the qualifying sheets to the processed media output tray 190.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention includes all modifications, equivalents, and alternatives falling within the spirit and scope of the invention as defined by the following appended claims.

What is claimed is:

1. A media qualification device comprising:

an input tray configured to hold a plurality of media sheets of a single media type;

a sensor configured to detect at least one media characteristic of each of the plurality of media sheets of the single media type;

a controller electrically coupled to the sensor, the controller configured to grade the plurality of media sheets into at least a usable grade of the single media type and an unusable grade of the single media type according to the at least one media characteristic corresponding to each of the plurality of media sheets;

a usable media path configured to receive ones of the plurality of media sheets of the single media type graded into the usable grade; and an unusable media path configured to receive ones of the plurality of media sheets of the single media type graded into the unusable grade, and wherein the media qualification device is configured to detachably attach to a sheet-fed device.

2. The media qualification device of claim 1, wherein the at least one media characteristic is selected from the group consisting of density, moisture content, curl, tendency to curl, crease, size, weight, stiffness, surface texture) electrical uniformity, output data, usable side and previous fusion.

3. The media qualification device of claim 1, further comprising an input/output device electrically coupled to the controller, the input/output device configured to provide grading parameters to the controller.

4. The media qualification device of claim 3, wherein the input/output device is selected from a group consisting of a switch, a control panel, a processor, a microcontroller, a computer, a memory device and a sheet-fed device.

5. The media qualification device of claim 1, wherein the usable media path comprises a plurality of grade paths and the controller is further configured to sort the plurality of media sheets according to a plurality of grades of the at least one media characteristic.

6. The media qualification device of claim 1, wherein the usable media path is configured to feed graded sheets of the plurality of media sheets to the sheet-fed device.

7. A sheet-fed device comprising:

an input tray configured to hold a plurality of media sheets of a single media type;

imaging circuitry;

a sensor configured to detect at least one media characteristic of each of the plurality of media sheets of the single media type;

a controller electrically coupled to the sensor and the imaging circuitry, the controller configured to grade the plurality of media sheets into at least a usable grade of the single media type and an unusable grade of the single media type according to the at least one media characteristic corresponding to each of the plurality of media sheets;

an imaging path configured to receive ones of the plurality of media sheets of the single media type graded into the usable grade and provide the ones of the plurality of media sheets of the usable grade to the imaging circuitry for printing thereon; and an unusable media path configured to receive ones of the plurality of media sheets of the single media type graded into the unusable grade.

8. The sheet-fed device of claim 7, wherein the at least one media characteristic is selected from the group consisting of density, moisture content, curl, tendency to curl, crease, size, weight, stiffness, surface texture, electrical uniformity, output data, usable side and previous fusion.

9. A sheet-fed device comprising: an input tray configured to hold a plurality of media sheets of a single media type:

imaging circuitry:

a sensor configured to detect at least one media characteristic of each of the plurality of media sheets of the single media type:

a controller electrically coupled to the sensor and the imaging circuitry, the controller configured to grade the plurality of media sheets into at least a usable grade of the single media type and an unusable grade of the single media type according to the at least one media characteristic corresponding to each of the plurality of media sheets:

an imaging path configured to receive ones of the plurality of media sheets of the single media type graded into the usable grade:

an unusable media path configured to receive ones of the plurality of media sheets of the single media type graded into the unusable grade: and an input/output device electrically coupled to the controller, the input/output device configured to provide grading parameters to the controller.

10. The sheet-fed device of claim 9, wherein the input/output device is selected from a group consisting of a switch, a control panel, a processor, a microcontroller, a computer, and a memory device.

11. A method for qualifying media for use with a sheet-fed device, the method comprising: selecting a sheet of a single type of media from an input tray;

transporting the sheet past a sensor configured to detect at least one media characteristic of the sheet of the single media type;

collecting data from the sensor corresponding to the at least one media characteristic of the sheet of the single media type;

analyzing the data corresponding to the at least one media characteristic of the sheet of the single media type;

querying whether the analyzed data qualifies the sheet for use with the sheet-fed device;

if yes, sorting the sheet to a first output path; and if no, sorting the sheet to a second output path.

12. The method of claim 11, wherein analyzing the at least one media characteristic of the sheet of the single media type comprises determining a characteristic of the sheet selected from the group consisting of density, moisture content, curl, tendency to curl, crease, size, weight, stiffness, surface texture, electrical uniformity, output data, usable side and previous fusion.

13. The method of claim 11, wherein querying whether the analyzed data qualifies the sheet for use with the sheet-fed device comprises:

selecting grade parameters; and comparing the analyzed data corresponding to the at least one media characteristic of the sheet of the single media type to selected grade parameters.

14. The method of claim 11, wherein sorting the sheet to the first output path comprises performing an imaging process on the sheet.

* * * * *

UNITED STATES PATENT AND TRADEMARK OFFICE

CERTIFICATE OF CORRECTION

PATENT NO. : 7,048,272 B2
APPLICATION NO. : 10/302432
DATED : May 23, 2006
INVENTOR(S) : D. Travis Lay et al.

It is certified that error appears in the above-identified patent and that said Letters Patent is hereby corrected as shown below:

In column 7, line 53, in Claim 2, delete "texture)" and insert -- texture, --, therefor.

In column 8, line 32, in Claim 9, delete "type:" and insert -- type; --, therefor.

In column 8, line 33, in Claim 9, delete "circuitry:" and insert -- circuitry; --, therefor.

In column 8, line 36, in Claim 9, delete "type:" and insert -- type; --, therefor.

In column 8, line 43, in Claim 9, delete "sheet:" and insert -- sheet; --, therefor.

In column 8, line 46, in Claim 9, delete "grade:" and insert -- grade; --, therefor.

In column 8, line 49, in Claim 9, delete "grade:" and insert -- grade; --, therefor.

Signed and Sealed this

Eleventh Day of August, 2009

David J. Kappos

David J. Kappos
*Director of the United States Patent and Trademark Office*